United States Patent [19]

Feldstein

[11] 3,946,126

[45] Mar. 23, 1976

[54] METHOD OF ELECTROLESS NICKEL PLATING

[75] Inventor: Nathan Feldstein, Kendall Park, N.J.

[73] Assignee: RCA Corporation, New York, N.Y.

[22] Filed: Apr. 21, 1972

[21] Appl. No.: 246,474

Related U.S. Application Data

[62] Division of Ser. No. 778,105, Nov. 22, 1968, abandoned.

[52] U.S. Cl. ..... 427/283; 106/1; 427/287

[51] Int. Cl. ..... C23c 3/02

[58] Field of Search ..... 117/130 B; 106/1

[56] References Cited

UNITED STATES PATENTS

| | | | |
|---|---|---|---|
| 3,140,188 | 7/1964 | Zirngiebl et al. | 106/1 |
| 3,338,726 | 8/1967 | Berzins | 117/130 BX |
| 3,403,035 | 9/1968 | Schneble et al. | 106/1 |

OTHER PUBLICATIONS

Schwartz, Technical Proceedings of the American Electroplaters Society (1960) pp. 176–183.

*Primary Examiner*—Ralph S. Kendall

*Attorney, Agent, or Firm*—G. H. Bruestle; W. S. Hill

[57] ABSTRACT

A method for the electroless deposition of nickel on a substrate without pretreatment of the substrate, in which the reducing agent is an amine borane compound, the relatively high pH is maintained with $NH_4OH$ plus a strong alkali, and the complexing agent is pyrophosphate anion.

1 Claim, 3 Drawing Figures

METHOD OF ELECTROLESS NICKEL PLATING

BACKGROUND OF THE INVENTION

This application is a division of application Ser. No. 778,105, filed Nov. 22, 1968 now abandoned.

It has been well known that a number of metals may be deposited autocatalytically on various substrates, including some which are non-metallic, from a plating bath, without the use of an electric current. This type of process has become known as "electroless deposition". Some substrates require pre-treatment as with a catalyst, such as a palladium salt, prior to deposition of the metal. Other substrates themselves exert sufficient catalytic action without further preparatory treatment.

Nickel is one of the metals which have been deposited successfully by electroless techniques. One type of bath which has been widely used for electroless deposition of nickel contains (a) a salt that furnishes nickel ions, (b) a pyrophosphate which functions as a complexing agent for nickel ions to prevent formation of undesired precipitates, (c) ammonium hydroxide which both provides hydroxyl ions to maintain an alkaline pH and also aids in complexing the nickel ions, and (d) a hypophosphite which serves as a reducing agent for the nickel compounds.

For some uses, it is desirable to have a nickel deposit which does not contain phosphorus. One such instance is in the manufacture of some types of semiconductor devices where nickel is deposited directly on the semiconductor. body in the making of an ohmic electrode contact. The semiconductor may be silicon, for example. If relatively high temperatures are used in later processing steps in manufacturing the device, phosphorus may diffuse out of the nickel layer and penetrate the semiconductor. Since phosphorus is an N type impurity in silicon, its presence can alter the electrical characteristics of the device, and the change may not be desired. An example of this is where ohmic contact is being made to a P type region.

Another drawback in using nickel-phosphorus alloy deposits of the prior art is that the phosphorus content is usually 5–15% by weight and this is sufficient to produce bad ohmic contacts due to separation layers forming during heat treatment often needed in device manufacture.

A higher purity nickel layer is therefore desirable in semiconductor device manufacture in order to assure higher uniformity of product and better performance.

Another characteristc of prior art electroless nickel deposition baths containing a hypophosphite reducing agent is that the metal will not deposit on many metal surfaces without treating the substrate first with a catalytic agent or using some other predeposition procedure. It is desirable to eliminate such predeposition treatment whenever possible.

It has also been known to deposit nickel electrolessly using an amine borane compound as a reducing agent. However, the deposition has usually been carried out at relatively low pH values and at temperatures above room temperature, and the deposits have contained appreciable percentages of boron derived from the borane.

SUMMARY OF THE INVENTION

An important feature of the present invention is the provision of an improved electroless plating method using an aqueous alkaline bath for the electroless deposition of nickel on a substrate, comprising a nickel salt, a pyrophosphate complexing agent for nickel ions, ammonium hydroxide, and a substituted amine borane reducing agent having one or more low molecular weight side chains such as methyl or ethyl as substituents.

A further feature of the invention is an improved method of electrolessly depositing nickel on certain substrates without subjecting those substrates to any activating treatment prior to applying the plating bath described above.

THE DRAWING

FIG. 1 is a graph which compares deposition rate of nickel, using an amine-borane reducing agent, (a) where only ammonium hydroxide is present to control pH levels, and (b) where sodium hydroxide is present in addition to ammonium hydroxide, in the improved baths of the present invention;

FIG. 2 is a graph of deposition rate of nickel vs. concentration of nickel salt, with pH held at a particular constant value, using dimethylamine borane reducing agent in a plating bath of the invention, and FIG. 3 is a graph of deposition rate of nickel vs. concentration of dimethylamine borane reducing agent at a particular concentration of a nickel salt, and at a particular pH using the plating baths of the invention.

DETAILED DESCRIPTION

In the present invention, nickel may be deposited electrolessly on many different substrates. Examples of compositions of baths used in the method of the invention are given in the following table.

TABLE

| Bath Ingredient | Chemical Formula | Concentration Range | Preferred Concentration |
|---|---|---|---|
| nickel chloride or | $NiCl_2.6H_2O$ | 10–45g./L of bath | 22g./L of bath |
| nickel sulfate | $NiSO_4.6H_2O$ | 10–50g./L of bath | 25g./L of bath |
| sodium pyrophosphate | $Na_4P_2O_7.10H_2O$ | 10–100g./L of bath | 50g./L of bath |
| ammonium hydroxide (58% by wt.) | $NH_4OH$ | 5–40cc./L of bath | 20cc./L of bath |
| dimethylamine borane | $(CH_3)_2NHBH_3$ | 0.1–3g./L of bath | 1.5g./L of bath |

In the bath composition of the above Table, the amount of dimethylamine borane is based on room temperature operation of the process. If the temperature is raised the amount of the borane can be decreased. Also, methyl amine borane can be used as the reducing agent and, since this substance is a stronger reducing agent than the corresponding dimethyl compound, smaller amounts are required. In general, the reducing agent may be a mono or di- substituted amine borane where the side chain is of low molecular weight such as methyl or ethyl. Other specific examples are mono-ethyl- and diethyl amine borane.

It had previously been known that, using the nickel-phosphorus type bath, nickel could be electrolessly deposited at room temperature on iron, cobalt, nickel, ruthenium, rhodium, palladium, osmium, iridium and platinum without pretreating the substrate to make it catalytic. It has now been found that, in addition to these metals, when the baths of the present invention are used, nickel can also be deposited at room temperature on copper, silver, gold, vanadium, chromium and titanium without pretreating the substrate to catalyze it. It can also be deposited, without pretreatment, on aluminum, tungsten and molybdenum at a temperature of 40°C. and above, and on selenium at 90°C. and above.

A desirable feature of any electroless plating bath is that it have a constant deposition rate over a substantial range of pH. If the plating rate varies too rapidly, it is difficult to deposit a controlled thickness of metal in a given period of time. Under normal conditions, where ammonium hydroxide is the principal source of hydroxyl ions in a plating bath, pH continuously decreases due to evaporation loss of ammonia. It was previously observed that this caused wide fluctuations of the rate of nickel deposition. However, it was also previously found by the present inventor that, if the pH level is first established with the proper amount of ammonium hydroxide, and the pH is then raised by addition of any one of the strong bases such as lithium hydroxide, sodium hydroxide, potassium hydroxide, or tetraethylammonium hydroxide, plating rate of nickel in a nickel-phosphorus type bath remains fairly constant over a considerable range of pH.

Figure 1:
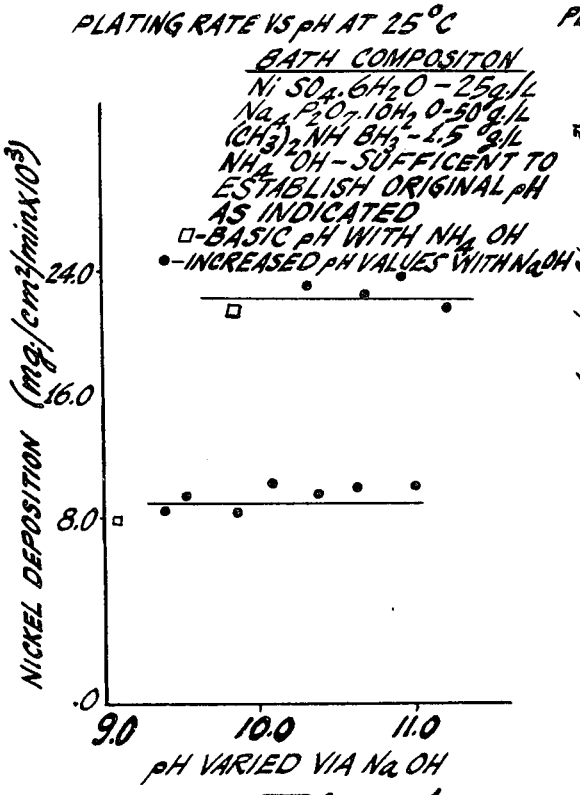

An illustration of use of a strong base (NaOH) to maintain a constant plating rate in the baths of the present invention is shown in the graph of FIG. 1. The points plotted with square dots show that a large difference of deposition rate of nickel is obtained when the pH is established using $NH_4OH$ as the only source of hydroxyl ions. The two series of points plotted with solid, round dots show that if a basic pH level is first established with $NH_4OH$ and then NaOH is added in various amounts to increase the pH, the nickel deposition rate remains fairly constant over a substantial range of pH. The practical effect of this is that, during a lengthy nickel deposition run, it is not necessary to be constantly adding a basic substance to maintain the pH constant.

Figure 2:
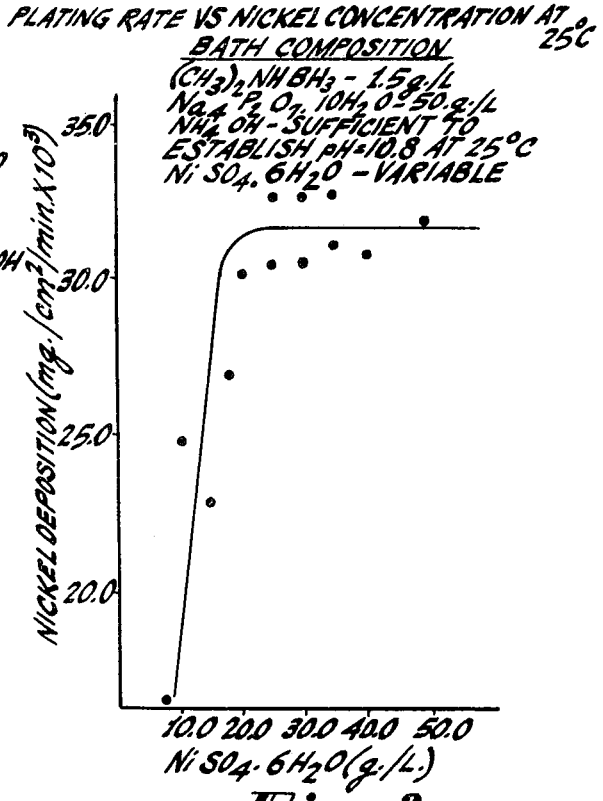

A method of keeping the nickel deposition rate substantially independent of nickel ion concentration, using the amine-borane reducing agent baths of the present invention, is illustrated in the graph of FIG. 2. This graph shows that if dimethylamine borane concentration is 1.5 g./liter and if the $Na_4P_2O_7.10H_2O$ concentration is 50.0 g./liter, and pH is 10.8 at 25°C. with $NH_4OH$, nickel deposition rate is fairly constant as $NiSO_4.6H_2O$ concentration is varied between about 20 g./liter and 50 g./liter.

Figure 3:
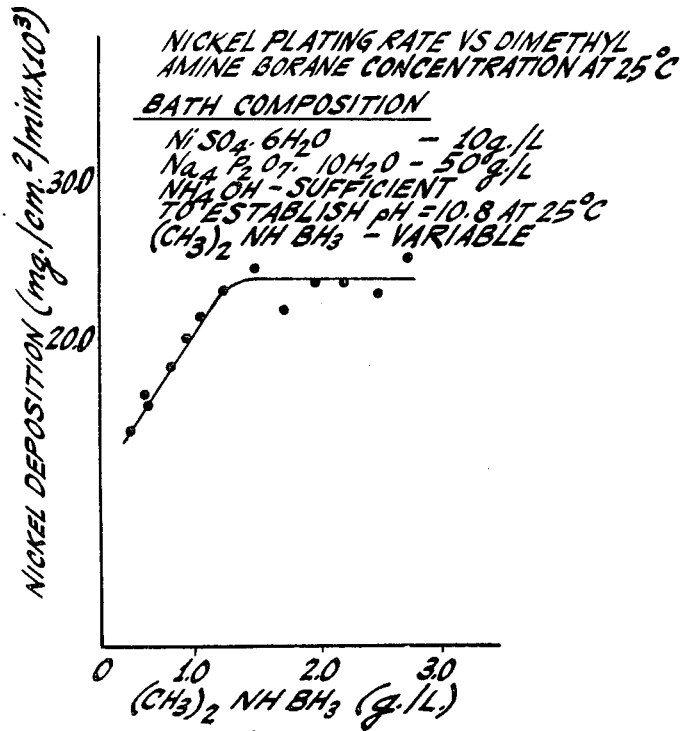

The baths of the present invention can also be made up such that nickel deposition rate is independent of dimethylamine borane concentration. This is illustrated in the graph of FIG. 3. This graph shows that for a bath in which $NiSO_4.6H_2O$ concentration is 10 g./liter, $Na_4P_2O_7.10H_2O$ concentration is 50 g./liter, and pH is 10.8 at 25°C. with $NH_4OH$, rate of deposition of nickel is substantially constant when concentration of dimethylamine borane varies between about 1.5 g./liter and 3.0 g./liter.

Another advantage of using the electroless nickel plating baths of the present invention is that they can be used to selectively deposit nickel on molybdenum-manganese or on molybdenum conductors disposed on a ceramic substrate without depositing nickel on the ceramic. Ceramic wafers having molybdenum-manganese or molybdenum conductors and conductor pads (often called "flat-packs") are used for mounting integrated circuits. The semiconductor chips and external connectors are brazed to the moly-manganese or molybdenum areas. Nickel is usually deposited on the moly-manganese or molybdenum to improve the brazing quality.

When hypophosphite type baths were used to deposit the nickel, an activator, such as palladium, was needed to catalyze the moly-manganese or molybdenum surfaces so that the nickel deposit would be initiated. The palladium was applied by immersing the assembly of ceramic and conductor areas in a solution containing hydrochloric acid and $PdCl_2$. Some of the solution often became entrapped in the pores of the ceramic causing some palladium to deposit thereon. This, in turn, caused nickel to later deposit on the ceramic. To eliminate the unwanted palladium, further treatment was necessary, such as rinsing in hot, concentrated hydrochloric acid.

With the present baths it has been found that no activation treatment is required to deposit nickel on the moly-manganese or molybdenum areas. Thus, the deposition of nickel on the metal conductors of the flat-pack is greatly facilitated and, at the same time, the unwanted deposition of nickel on the ceramic is eliminated.

An example of a bath that can be used to deposit nickel on the conducting areas of a ceramic flat-pack having moly-manganese or molybdenum conducting areas is:

| | |
|---|---|
| $NiSO_4.6H_2O$ | — 25.0 g./L |
| $Na_4P_2O_7.10H_2O$ | — 50.0 g./L |
| $(CH_3)_2NHBH_3$ | — 1.5 g./L |
| $NH_4OH$ to pH | — 9.0 to 11.0 |

when this bath is operated at 40°C. and above, nickel deposits auto-catalytically on the molybdenum manganese or molybdenum conductors and does not deposit on the ceramic. This results in a cost reduction in the manufacture of packaged integrated circuits.

I claim:

1. A method of depositing nickel electrolessly on the metallic surfaces only of an assembly comprising a ceramic and conducting portions made of an alloy of molybdenum and manganese, said method comprising:

treating said assembly with a bath, at 40° C or higher, which contains:

| | |
|---|---|
| a nickel salt | 10 – 50 g/L |
| a pyrophosphate | 10 – 100 g/L |
| ammonium hydroxide | 5 – 40 cc/L (58% by wt. solution) |
| dimethylamine borane | 0.1 – 3 g/L. |

* * * * *